US009334596B2

(12) United States Patent
Vaughan et al.

(10) Patent No.: US 9,334,596 B2
(45) Date of Patent: May 10, 2016

(54) METHODS AND DEVICES FOR CONTROLLING A TUFTING MACHINE FOR FORMING TUFTED CARPET

(71) Applicant: SHAW INDUSTRIES GROUP, INC., Dalton, GA (US)

(72) Inventors: Neil Vaughan, Rydal, GA (US); Mark Honeycutt, Cartersville, GA (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 14/326,236

(22) Filed: Jul. 8, 2014

(65) Prior Publication Data

US 2015/0007760 A1 Jan. 8, 2015

Related U.S. Application Data

(63) Continuation of application No. 13/873,810, filed on Apr. 30, 2013, now Pat. No. 8,770,122, which is a continuation of application No. 13/283,789, filed on Oct. 28, 2011, now Pat. No. 8,430,043.

(60) Provisional application No. 61/407,604, filed on Oct. 28, 2010.

(51) Int. Cl.
*D05C 15/18* (2006.01)
*D05C 15/26* (2006.01)
(Continued)

(52) U.S. Cl.
CPC *D05C 15/18* (2013.01); *D05C 5/04* (2013.01); *D05C 15/26* (2013.01); *D05B 19/08* (2013.01)

(58) Field of Classification Search
CPC ..... D05C 15/00; D05C 15/04; D05C 15/10; D05C 15/12; D05C 15/16; D05C 15/18; D05C 15/26; D05C 15/32; D05C 15/34; D05C 15/36; D05B 19/02–19/14; G05B 2219/2626; G05B 2219/45195
USPC ..... 112/475.23, 80.7; 700/136
See application file for complete search history.

(56) References Cited

U.S. PATENT DOCUMENTS 2,853,033 A * 9/1958 Crawford ..... 112/80.72
3,067,701 A 12/1962 Wilcox
(Continued)

FOREIGN PATENT DOCUMENTS

AU 2011337101 A1 5/2013
CN 103221601 A 7/2013
(Continued)

OTHER PUBLICATIONS

U.S. Appl. No. 61/257,699, Vaughan et al.
(Continued)

*Primary Examiner* — Ismael Izaguirre
(74) *Attorney, Agent, or Firm* — Ballard Spahr LLP

(57) ABSTRACT

The invention relates to a control system for a tufting machine configured for forming tufted carpet. The tufting machine can have a system controller in communication with the tufting machine and with a plurality of yarn feed controllers for controlling operation of yarn feed motors that are configured to supply yarn from a source of yarn to the tufting machine. The system controller is programmable to enable input of a plurality of predetermined yarn feed profiles for selected stitches of a programmed pattern to be tufted such that, although at least two of the predetermined yarn feed profiles can be different, substantially the same feed length of yarn is used from each of the plurality of yarns.

22 Claims, 4 Drawing Sheets

(51) Int. Cl.
*D05C 5/04* (2006.01)
*D05B 19/08* (2006.01)

(56) References Cited

U.S. PATENT DOCUMENTS

| | | | | |
|---|---|---|---|---|
| 3,356,048 | A | 12/1967 | Haas | |
| 3,529,560 | A | 9/1970 | Jackson | |
| 3,741,139 | A | 6/1973 | Frentress | |
| 3,762,346 | A | 10/1973 | Cobble | |
| 3,895,355 | A | 7/1975 | Shorrock | |
| 3,898,035 | A | 8/1975 | Tillotson | |
| 3,964,408 | A | 6/1976 | Smith | |
| 4,062,308 | A | 12/1977 | Spanel et al. | |
| 4,069,775 | A | 1/1978 | Bryant et al. | |
| 4,103,635 | A | 8/1978 | Sedlaczek | |
| 4,127,078 | A | 11/1978 | Spanel et al. | |
| 4,151,805 | A | 5/1979 | Long et al. | |
| 4,173,192 | A | 11/1979 | Schmidt et al. | |
| 4,254,718 | A | 3/1981 | Spanel et al. | |
| 4,313,578 | A | 2/1982 | Van Wilson et al. | |
| 4,416,205 | A | 11/1983 | Schwartz | |
| 4,519,332 | A * | 5/1985 | Fukuda | D05C 15/14 112/272 |
| 4,586,446 | A | 5/1986 | Cooper | |
| 4,790,252 | A | 12/1988 | Bardsley | |
| 4,870,915 | A | 10/1989 | Bagnall | |
| 4,895,087 | A | 1/1990 | Amos | |
| 4,981,091 | A | 1/1991 | Taylor et al. | |
| 5,094,178 | A | 3/1992 | Watkins | |
| 5,566,630 | A | 10/1996 | Burgess et al. | |
| 5,575,228 | A | 11/1996 | Padgett, III et al. | |
| 5,588,383 | A | 12/1996 | Davis et al. | |
| 5,743,306 | A | 4/1998 | Stewart et al. | |
| 5,769,012 | A | 6/1998 | Vaughan et al. | |
| 5,806,446 | A * | 9/1998 | Morrison | D05C 15/32 112/80.73 |
| 5,979,344 | A | 11/1999 | Christman, Jr. | |
| 5,983,815 | A | 11/1999 | Card | |
| 6,244,203 | B1 * | 6/2001 | Morgante | D05C 15/18 112/475.23 |
| 6,283,052 | B1 | 9/2001 | Pratt | |
| 6,550,407 | B1 | 4/2003 | Frost et al. | |
| 6,807,917 | B1 | 10/2004 | Christman et al. | |
| 6,834,601 | B2 | 12/2004 | Card et al. | |
| 6,877,447 | B2 | 4/2005 | Frost et al. | |
| 6,953,067 | B2 | 10/2005 | Verdiere et al. | |
| 7,096,806 | B2 | 8/2006 | Card et al. | |
| 7,347,151 | B1 | 3/2008 | Johnston et al. | |
| 7,426,895 | B2 | 9/2008 | Smith et al. | |
| 8,201,509 | B2 * | 6/2012 | Christman, Jr. | 112/475.23 |
| 8,256,364 | B2 | 9/2012 | Vaughan et al. | |
| 8,430,043 | B2 | 4/2013 | Vaughan et al. | |
| 8,443,743 | B2 | 5/2013 | Christman, Jr. | |
| 8,770,122 | B2 | 7/2014 | Vaughan et al. | |
| 2006/0070564 | A1 * | 4/2006 | Smith et al. | 112/80.3 |
| 2009/0101051 | A1 * | 4/2009 | Christman, Jr. | D05C 15/34 112/80.23 |
| 2009/0173262 | A1 * | 7/2009 | Wilson | D05C 15/18 112/80.73 |
| 2009/0205547 | A1 * | 8/2009 | Hall et al. | 112/80.41 |
| 2009/0260554 | A1 | 10/2009 | Hall et al. | |
| 2013/0047904 | A1 * | 2/2013 | Vaughan | D05B 19/10 112/80.23 |

FOREIGN PATENT DOCUMENTS

| | | | |
|---|---|---|---|
| CZ | 1372325 | | 10/1974 |
| EP | 2633112 | A1 | 9/2013 |
| GB | 425197 | | 3/1935 |
| WO | WO-01/59192 | A1 | 8/2001 |
| WO | WO-03/097913 | A1 | 11/2003 |
| WO | WO-2012/074642 | A1 | 6/2012 |

OTHER PUBLICATIONS

U.S. Appl. No. 61/407,604, Vaughan et al.

International Search Report issued Mar. 7, 2012 in international application PCT/US2011/058286, which was filed on Oct. 28, 2011 and published as WO/20120/074642 on Jun. 7, 2012 (Inventor—Vaughan; Applicant Shaw Industries Group) (2 pages).

Written Opinion issued Mar. 7, 2012 in international application PCT/US2011/058286, which was filed on Oct. 28, 2011 and published as WO/20120/074642 on Jun. 7, 2012 (Inventor—Vaughan; Applicant Shaw Industries Group) (5 pages).

International Preliminary Report on Patentability issued Apr. 30, 2013 in international application PCT/US2011/058286, which was filed on Oct. 28, 2011 and published as WO/20120/074642 on Jun. 7, 2012 (Inventor—Vaughan; Applicant Shaw Industries Group) (5 pages).

Examination Report issued by the Intellectual Property Office of Australia on Feb. 25, 2015, for application AU 2011337101, filed on Oct. 28, 2011, and granted on Sep. 17, 2015 (Applicant—Shaw Industries Group, Inc. // Inventor—Vaughan) (3 pages).

Notice of Acceptance issued by the Intellectual Property Office of Australia on May 20, 2015, for application AU 2011337101, filed on Oct. 28, 2011, and granted on Sep. 17, 2015 (Applicant—Shaw Industries Group, Inc. // Inventor—Vaughan) (2 pages).

First Office Action issue by the State Intellectual Property Office of the People's Republic of China for on Dec. 20, 2013 for application CN 201180054899.X, filed on Oct. 28, 2011, and granted on Oct. 29, 2014 (Applicant—Shaw Industries Group, Inc. // Inventor—Vaughan) (4 pages—English Translation 5 pages).

Extended European Search Report issued by the European Patent Office on Sep. 21, 2015 for application EP 11844649.1, filed on Oct. 28, 2011 (Applicant—Shaw Industries Group, Inc. // Inventor—Vaughan) (6 pages).

* cited by examiner

METHODS AND DEVICES FOR CONTROLLING A TUFTING MACHINE FOR FORMING TUFTED CARPET

This is a continuation of U.S. application Ser. No. 13/873,810 filed Apr. 30, 2013, which is a continuation of U.S. application Ser. No. 13/283,789, filed on Oct. 28, 2011, now U.S. Pat. No. 8,430,043, issued Apr. 30, 2013, which claims the benefit of priority to U.S. Provisional Application No. 61/407,604, filed on Oct. 28, 2010. The disclosure of each of the above-referenced applications is hereby incorporated herein by reference in their entirety.

FIELD OF THE INVENTION

This invention relates to a tufting machine for forming tufted carpet. More specifically, this invention relates to a control system for a tufting machine for forming patterned tufted articles.

BACKGROUND OF THE INVENTION

During the operation of known tufting machines, loops of yarn are inserted into a carpet backing to create a profile of yarns projecting from the carpet backing. Individual yarns and/or groups of yarn can project from the carpet backing a desired height to form a pattern or give a desired appearance to the face of the carpet. However, when yarns project from the backing at different heights, yarn is consumed at different rates, which creates wasted yarn and add complexity to the manufacturing process.

Thus, there is a need in the pertinent art for methods and device for controlling the feed length of yarn fed to a tufting machine so that the length of yarn consumed by the tufting machine is substantially the same per a predetermined amount of tufted carpet, regardless of the pattern being tufted.

SUMMARY

The invention relates to a control system for a tufting machine of the type having a plurality of needles for forming tufted carpet. The tufted carpet can be formed from tufts of yarn having different heights relative to a backing material. The tufts can be arranged so that patterns are apparent on the face of the carpet.

In one aspect, the control system for the tufting machine comprises a system controller in communication with the tufting machine for controlling operation of the tufting machine. In another aspect, the system controller can be in communication with a plurality of yarn feed controllers for controlling operation of yarn feed motors which supply yarn from a source of yarn to the tufting machine.

In one embodiment, the system controller can be programmable to enable input of a plurality of predetermined yarn feed profiles for selected stitches of a programmed pattern to be tufted. In another aspect, the system controller can be programmable to control the operation of the respective yarn feed controllers to feed yarns to the needles for each selected stitch to be tufted according to the respective predetermined yarn feed profile. In this embodiment, although at least two of the predetermined yarn feed profiles can be different, for each repeat of the programmed pattern, substantially the same feed length of yarn can be used from each of the plurality of yarns.

In one aspect, each predetermined yarn feed profile can be programmed by determining a base yarn feed value for each stitch of the yarn for each pattern repeat of the programmed pattern. In another aspect, the yarn feed profile for at least one stitch for each pattern repeat can be varied from the base yarn feed value.

In another embodiment, the system controller can be programmable to enable input of a plurality of N predetermined yarn feed profiles for selected stitches of the programmed pattern. In another aspect, after every X pattern repeat, the system controller can index each of the plurality of N predetermined yarn feed profiles to operatively control a different yarn feed controller. In still another aspect, the system controller can control the operation of the respective yarn feed controllers to feed yarns to the plurality of needles for each selected stitch to be tufted according to the selected predetermined yarn feed profile. In this embodiment, after (N·X) repeats of the pattern repeat, substantially the same feed length of yarn can be used from each of the plurality of yarns.

In one aspect, each predetermined yarn feed profile can be programmed by determining a base yarn feed value for each stitch of the yarn for each pattern repeat of the programmed pattern. In another aspect, the yarn feed profile for at least one stitch for each pattern repeat can be varied from the base yarn feed value.

DESCRIPTION OF THE DRAWINGS

The accompanying drawings, which are incorporated in and constitute a part of this specification, illustrate certain aspects of the instant invention and together with the description, serve to explain, without limitation, the principles of the invention. Like reference characters used therein indicate like parts throughout the several drawings.

DETAILED DESCRIPTION OF THE INVENTION

Figure 1:
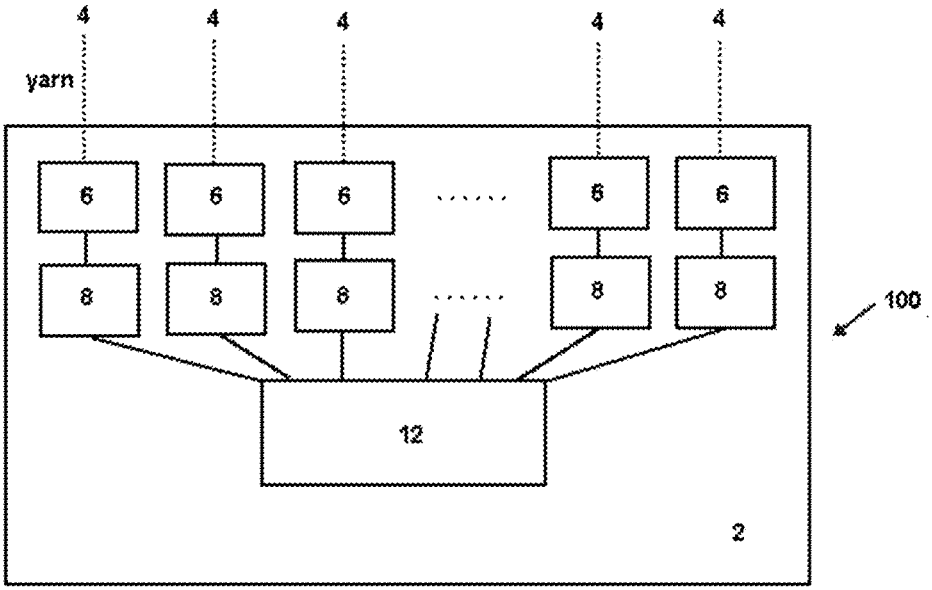
FIG. 1 is a schematic view of the control system for a tufting machine in accordance with one embodiment of this invention, the control system showing a source of yarns in communication with a plurality of yarn feed motors and a coupled plurality yarn feed controllers. A system controller is in communication with the plurality yarn feed controllers to effect control of the plurality of yarn feed motors.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a controller" can include two or more such controllers unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

In one aspect, the application relates to a tufting machine for forming tufted carpet. In one aspect, the tufting machine forms tufted carpet on a backing material moving in a machine direction through the tufting machine. In another aspect, the backing material can have a top surface.

The tufting machine can comprise means for inserting loops of yarn into the backing material. In one aspect, the loops of yarn can be inserted into the backing material to form sequential substantially linear rows of yarn tufts thereon the backing material. In another aspect, the sequential substantially linear rows of yarn tufts thereon the backing material can be substantially transverse to the machine direction. It is contemplated that the sequential substantially linear rows of yarn tufts thereon the backing material can be spaced substantially equally apart in the machine direction.

In another aspect, the means for inserting loops of yarn into the backing material can comprise a needle bar having a plurality of needles mounted thereon. In still another aspect, the means for inserting loops of yarn into the backing material can comprise a plurality of needles carrying a plurality of yarns into the backing material as the backing material passes through the tufting machine at a desired rate. In another aspect, the means for inserting loops of yarn into the backing material can further comprise a series of loopers adapted to engage the needles for forming loop pile tufts. As one having ordinary skill in the pertinent art will appreciate, any means known in the art for inserting loops of yarn into a carpet backing can be used to insert loops of yarn into the backing material.

In another aspect, a portion of each yarn tuft can project therefrom the top surface of the backing material a predetermined height. In still another aspect, each yarn tuft can project therefrom the top surface of the backing material a predetermined height such that a pattern or a desired appearance is formed on the face of the carpet. For example, the predetermined height can vary or be substantially the same from tuft to tuft so that a pattern is formed on the face of the carpet. In yet another aspect, each yarn tuft can be a cut pile tuft, a loop tuft, or any variation thereof.

Figure 2:
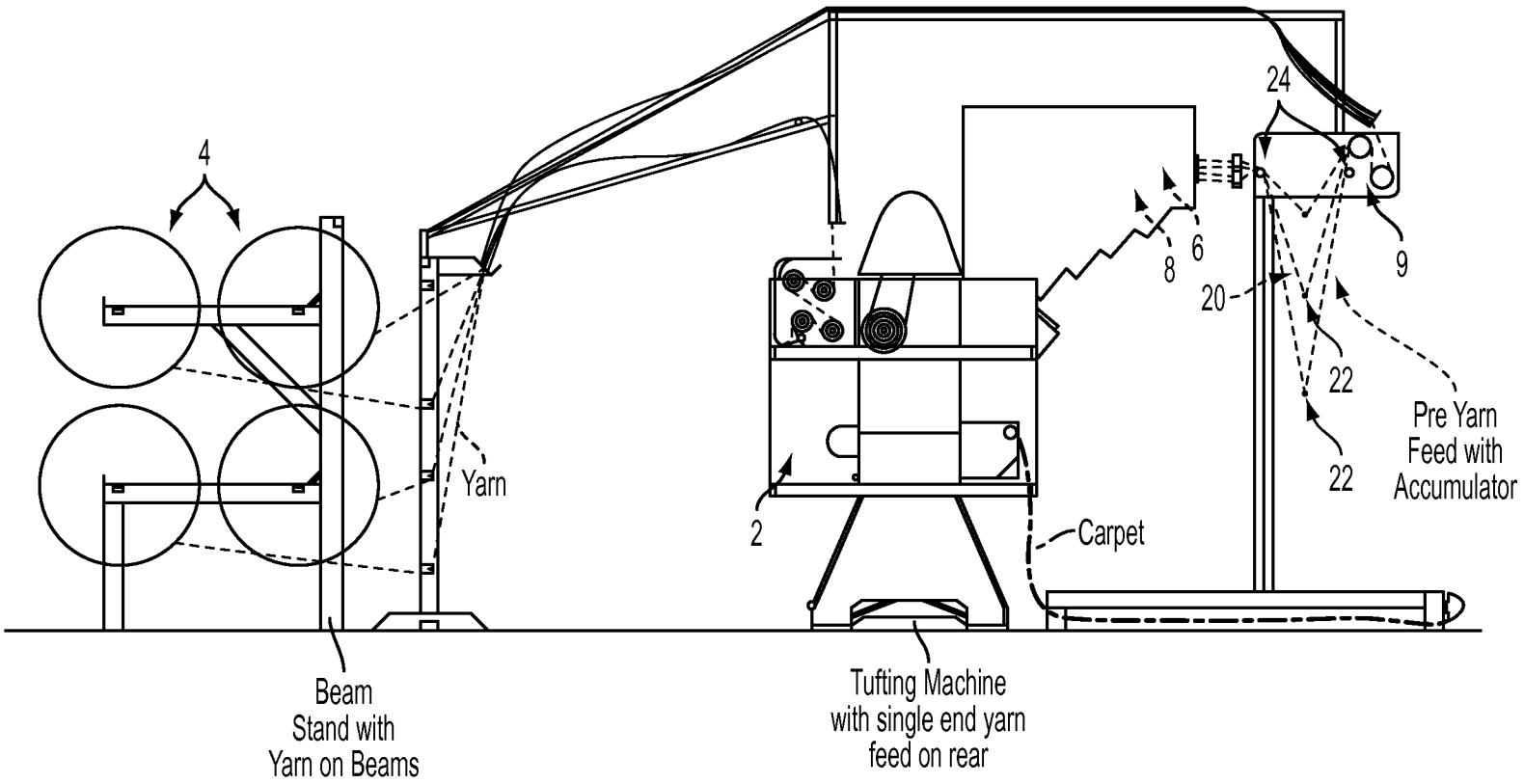
FIG. 2 is a schematic view of the control system for a tufting machine in accordance with one embodiment of this invention, showing a yarn accumulator system disposed between the source of yarns and the plurality of yarn feed motors.

In one aspect, and as exemplarily and schematically shown in FIGS. 1 and 2, a control system 100 for a tufting machine 2 for forming patterned tufted articles is provided. In another aspect, the control system can comprise at least one of a source of yarns 4, a plurality of yarn feed motors 6, a plurality of yarn feed controllers 8, and a system controller 12 in communication with the tufting machine. As one skilled in the art will appreciate, such a tufting machine in communication with at least one of a source of yarns, a plurality of yarn feed motors, a plurality of yarn feed controllers, and a system controller is known in the art and it is contemplate that any such conventional tufting system can be used with the process and method of the present invention.

According to one aspect, the source of yarns 4 can comprise a plurality of yarns, such as for example and without limitation, at least one creel or at least one beam. In another aspect, each yarn feed motor of the plurality of yarn feed motors 6 can be in communication with one yarn from the source of yarns and one needle of the plurality of needles of the tufting machine. In another aspect, each yarn feed controller 8 of the plurality of yarn feed controllers can be coupled to a respective yarn feed motor for controlling the amount of yarn being supplied by the respective yarn feed motor to a respective needle of the tufting machine. Thus, for each yarn of the plurality of yarns, there can be a respective yarn feed controller, a respective yarn feed motor, and a respective needle. In a further aspect, each yarn feed controller of the plurality of yarn feed controllers can provide yarn to a corresponding needle of the plurality of needles at a selectable yarn feed rate. In still a further aspect, each yarn feed controller of the plurality of yarn feed controllers can further comprise means for selectively adjusting the yarn feed rate.

In one aspect, the system controller 12 can be configured for controlling operation of the tufting machine. In another aspect, the system controller can be configured for controlling operation of the yarn feed controllers for controlling operation of the yarn feed motors. In this aspect, the control system can comprise a processor coupled to each yarn feed controller of the plurality of yarn feed controllers. In another aspect, the processor of the control system can be configured to control the respective yarn feed rate of each yarn feed controller of the plurality of yarn feed controllers in response to a predetermined yarn feed profile, described more fully below.

As one having ordinary skill in the pertinent art will appreciate, the processor can be any processing element known in the art, such as, without limitation, a personal computer or a server computer. As one having ordinary skill in the pertinent art will further appreciate, the processor can comprise any of a number of processing devices, systems or the like that are capable of operating in accordance with the embodiments of the invention. It is contemplated that the processor can be in communication with a memory that stores content, data, or the like. The memory can also store software applications, instructions, or the like for the processor to perform steps associated with varying the predetermined yarn feed profiles, as described herein. It is further contemplated that the processor can be connected to at least one interface or other means for displaying, transmitting, and/or receiving data, content, or the like. The interface can include at least one communication interface or other means for transmitting and/or receiving data, content, or the like, as well as at least one user interface that can include a display and/or a user input interface. The user input interface, in turn, can comprise any of a number of devices allowing the processor to receive data from a user, such as a keypad, a touch display, a joystick or other input device. In one aspect, the control system can be configured to signal at least one yarn feed controller of the plurality of yarn feed controllers to change its yarn feed rate to a selected yarn feed rate.

In one embodiment, the system controller 12 can be programmable to enable input of a plurality of predetermined yarn feed profiles for selected stitches of a programmed pattern to be tufted. In another aspect, the system controller can further be programmable to control the operation of the respective yarn feed controllers to feed yarns to the plurality of needles for each selected stitch to be tufted at a yarn feed rate according to the predetermined yarn feed profile. Thus, according to one aspect, the plurality of predetermined yarn feed profiles can indicate to the each of the yarn feed controllers how long to activate the respective yarn feed motors so that the yarn feed motors supply yarn to the backing material at a desired feed control rate, and so that the face of the carpet has a plurality of tufts having desired tuft heights.

In one aspect, each predetermined yarn feed profiles of the plurality of predetermined yarn feed profiles can be the same. Alternatively, in another aspect, at least two predetermined yarn feed profiles of the plurality of predetermined yarn feed profiles can be different. In another aspect, an average feed control rate of the plurality of predetermined yarn feed profiles can be calculated by averaging a feed control rate for each yarn of a respective yarn feed profile.

In another aspect, for each repeat of the programmed pattern, substantially the same feed length of yarn can be used for each of the plurality of yarns. In other aspects, for each repeat of the programmed pattern, the feed length of yarn can vary between each of the plurality of yarns by less than about 1%, 2%, 3%, 4%, 5%, 6%, 7%, 8%, 9%, 10%, 12%, 14%, 16%, 18%, 20%, 25%, 30%, 35%, 40%, 45%, or 50%.

In one aspect, in order to program each predetermined yarn feed profile, a base yarn feed value can be determined for each stitch of the yarn for each pattern repeat of the programmed pattern. The base yarn feed value can represent the amount of yarn required to make each stitch such that the resultant tuft has a desired height. In another aspect, after determination of the base yarn feed value, the yarn feed profile can be varied from the base yarn feed value for at least one stitch of the yarn for each pattern repeat. In one aspect, the amount of variation from the base yarn feed value can be less than 0.3 inches, less than 0.2 inches, less than 0.1 inches or less than 0.05 inches. In another aspect, the amount of variation can be a positive variation in yarn feed length from the base yarn feed value, such that an actual yarn feed length is greater than the base yarn feed value. Optionally, the amount of variation can be a negative variation in yarn feed length from the base yarn feed value, such that the actual yarn feed length is less than the base yarn feed value.

In another aspect, the process of programming each predetermined yard feed profile can be repeated for each predetermined yarn feed profile until the feed length of yarn per pattern repeat is substantially the same for the plurality of predetermined yarn feed rates. In still another aspect, the process of programming each predetermined yard feed profile can be repeated for each predetermined yarn feed profile until the feed length of yarn per pattern repeat varies between each of the plurality of yarn feed rates by less than about 1%, 2%, 3%, 4%, 5%, 6%, 7%, 8%, 9%, 10%, 12%, 14%, 16%, 18%, 20%, 25%, 30%, 35%, 40%, 45%, or 50%.

In an example, if a first yarn feed profile requires the respective yarn feed length to be 13 inches per pattern repeat, and a second yarn feed profile requires the respective yarn feed length to be 12 inches per pattern repeat, the first yarn feed profile can be decreased by 0.05 inches for twenty stitches for each pattern repeat in order to make the feed length of yarn per pattern repeat substantially the same for the plurality of predetermined yarn feed rates. Alternatively, the first yarn feed profile can be decreased by 0.02 inches for 25 stitches for each pattern repeat and the second yarn feed profile can be increased by 0.02 inches for 25 stitches for each pattern repeat in order to make the feed length of yarn per pattern repeat substantially the same for the plurality of predetermined yarn feed rates.

As can be appreciated, various combinations of decreases to the first yarn feed profile and/or increases to the second yarn feed profile can cause substantially the same feed length of yarn to be used for each of the plurality of yarns. As can also be appreciated, the amount to vary a yarn feed profile from the base yarn feed value can be selected based on the number of stitches per pattern repeat, i.e., the more stitches per pattern repeat, the greater number of stitches to spread the change to the base yarn feed value, so that the change per stitch is less or not noticeable.

Figure 3:
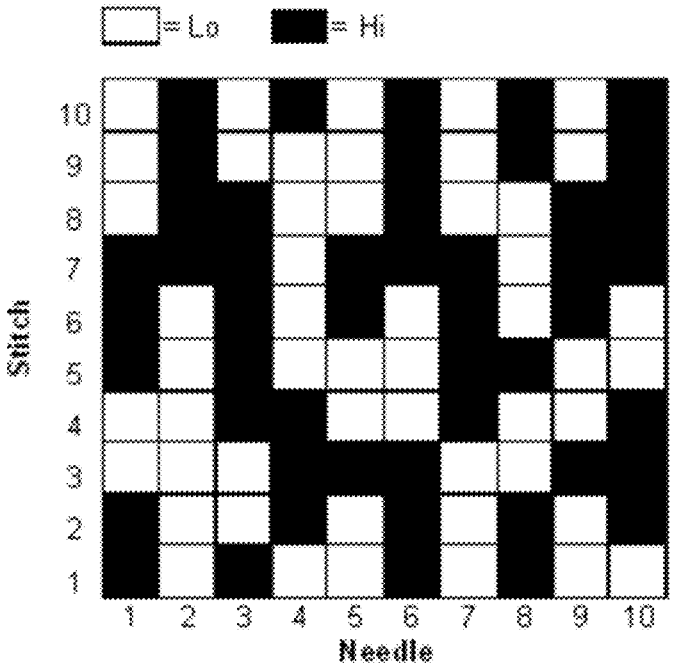
FIG. 3 is an exemplary pattern for input into the control system of the tufting machine for the production of carpet having a varied pile height in which at least two predetermined yarn feed profiles of a plurality of predetermined yarn feed profiles are different. In this example, substantially the same feed length of yarn is used for each of the plurality of yarns in each repeat of the programmed pattern.

Referring to FIG. 3 and the table below, one exemplary pattern for input into the system controller 12 of the control system of the tufting machine is shown for the production of carpet having a varied pile height in which at least two predetermined yarn feed profiles of a plurality of predetermined yarn feed profiles are different. As illustrated, each white square denotes a Low feed rate profile and each black square denotes a Hi feed rate profile for each of the needle/stitch combinations in the exemplary 10×10 pattern.

| Needle | # Lo | Lo FR | # Hi | Hi FR | Yarn Length | Diff from Avg | Adjustment | New Lo | New Yarn Length |
|---|---|---|---|---|---|---|---|---|---|
| 1 | 5 | 0.300 | 5 | 0.500 | 4 | −0.02 | −0.004 | 0.296 | 3.98 |
| 2 | 6 | 0.300 | 4 | 0.500 | 3.8 | 0.18 | 0.030 | 0.330 | 3.98 |
| 3 | 4 | 0.300 | 6 | 0.500 | 4.2 | −0.22 | −0.055 | 0.245 | 3.98 |
| 4 | 6 | 0.300 | 4 | 0.500 | 3.8 | 0.18 | 0.030 | 0.330 | 3.98 |
| 5 | 7 | 0.300 | 3 | 0.500 | 3.6 | 0.38 | 0.054 | 0.354 | 3.98 |
| 6 | 3 | 0.300 | 7 | 0.500 | 4.4 | −0.42 | −0.140 | 0.160 | 3.98 |
| 7 | 6 | 0.300 | 4 | 0.500 | 3.8 | 0.18 | 0.030 | 0.330 | 3.98 |
| 8 | 5 | 0.300 | 5 | 0.500 | 4 | −0.02 | −0.004 | 0.296 | 3.98 |

-continued

| Needle | # Lo | Lo FR | # Hi | Hi FR | Yarn Length | Diff from Avg | Adjustment | New Lo | New Yarn Length |
|---|---|---|---|---|---|---|---|---|---|
| 9 | 6 | 0.300 | 4 | 0.500 | 3.8 | 0.18 | 0.030 | 0.330 | 3.98 |
| 10 | 3 | 0.300 | 7 | 0.500 | 4.4 | −0.42 | −0.140 | 0.160 | 3.98 |
| | | | | Avg. Yarn Length | 3.98 | | | | |

Where for each needle:
FR = Feedrate
Yarn Length = (# Lo × Lo FR) + (# Hi × Hi FR)
Avg. Yarn Length = Sum of Yarn Lengths for each needle/# Stitches
Diff. from Avg. = (Avg Yarn Length) − (Yarn Length)
Adjustment = Diff from Avg./# Lo
New Lo = Lo FR + Adjustment
Such that:
New Yarn Length = (# Lo × New Lo FR) + (# Hi × Hi FR) = Avg. Yarn Length In this example, substantially the same feed length of yarn is used for each of the plurality of yarns in each repeat of the programmed pattern. As shown, variations in the new low of the respective pattern are made such that the yarn length for each of the yarns used in the entirety of the 10×10 pattern are substantially the same.

In another aspect, the control system 100 can further comprise a drive roll 9 in communication with the source of yarns. In this aspect, the drive roll can be configured to draw the plurality of yarns from the source of yarns at a substantially constant yarn feed rate. In another aspect, the substantially constant yarn feed rate can be equal to the average feed control rate of the plurality of yarn feed profiles. Optionally, the yarn feed rate can selectively be less than, equal to, or greater than the average feed control rate of the plurality of predetermined yarn feed profiles. In still another aspect, the drive roll can be positioned between the source of yarns and the plurality of yarn feed motors.

In another aspect and as shown in FIG. 2, the control system 100 can further comprise a yarn accumulator system 20 that is in communication with the source of yarns. In one aspect, the yarn accumulator system can be disposed between the source of yarns and the plurality of yarn feed motors. In still another aspect, the yarn accumulator system can be positioned between the drive roll and the plurality of yarn feed motors. In one aspect, the yarn accumulator system can comprise a plurality of weight elements 22 suspended above the ground by the respective yarns. In one example, each weight element 22 can have a lumen extending therethrough that is configured, or otherwise sized and shaped to allow for the free passage of one yarn. In operation, each yarn being fed to the tufting machine passes through one weight element 22.

Optionally, the yarn accumulator system can further comprise a pair of opposed spaced bars or rollers 24 that are elevated above the ground. In this aspect, each yarn being fed to the tufting machine passes over one of the spaced bars or rollers through one weight element 22 and subsequently over the other spaced bars or rollers.

As one skilled in the art will appreciate, as the yarn feed to each respective needle varied in accord with the method of the present invention, yarn can accumulate upstream of the respective yarn motors at an unequal rate. Thus, by passing each yarn through the yarn accumulator system 20, each yarn will be drawn downward due to the gravitational action of the weight element 22 as excess yarn accumulates over the programmed pattern and will we drawn upward due to the increased feed rate that is necessitated by the programmed pattern. The use of such a yarn accumulator system 22 can help to avoid unnecessary and undesired tangles in the plurality of yarns. As one can appreciate, such a yarn accumulator system 22 can be used in conjunction with yarns being supplied by at least one creel or at least one beam. In this aspect, one skilled in the art will further appreciate the usefulness of such a yarn accumulator system 22 when multiple yarn ends for multiple needles of the tufting machine are supplied by a single beam. It is further contemplated that any conventional accumulation system used in the textile production industry can be used as the yarn accumulator system of the control system 100 described herein.

In another embodiment, the system controller 12 can be programmable to enable input of a plurality of N predetermined yarn feed profiles for selected stitches of a programmed pattern to be tufted. In still another aspect, the system controller can further be programmable to index each of the plurality of N predetermined yarn feed profiles to operatively control a different yarn feed controller after every X pattern repeat. In yet another aspect, the system controller can further be programmable to control the operation of the respective yarn feed controllers to feed yarns to the plurality of needles for each selected stitch to be tufted according to the predetermined yarn feed profile. In this aspect, after (N·X) repeats of the pattern repeat, substantially the same feed length of yarn can be used from each of the plurality of yarns. In another aspect, after (N·X) repeats of the pattern repeat, the feed length of yarn can vary between each of the plurality of yarns by less than about 1%, 2%, 3%, 4%, 5%, 6%, 7%, 8%, 9%, 10%, 12%, 14%, 16%, 18%, 20%, 25%, 30%, 35%, 40%, 45%, or 50%. In one aspect, at least two predetermined yarn feed profiles of the plurality of N predetermined yarn feed profiles can be different.

In one example, if there are three different yarn feed profiles for selected stitches of a programmed pattern to be tufted, N=3. After every fourth pattern repeat, the system controller can be configured to index each yarn feed profile to a different yarn feed controller (X=4). Thus, after the fourth pattern repeat, the yarn feed profile could index by one so that a yarn feed profile is associated with an adjacent yarn feed controller for the fifth pattern repeat. In this example, after 12 repeats (3 yarn feed profiles×4 indexes=12) of the pattern repeat, substantially the same feed length of yarn can be used from each of the plurality of yarns.

According to another aspect, when X=1, i.e., when the yarn feed profile is indexed to operatively control a different yarn feed controller after every pattern repeat, the pattern repeat can be repeated N times for N predetermined yarn feed profiles. Each yarn feed controller can be controlled by a different one of the N predetermined yarn feed profiles for each of the N respective pattern repeats. In this aspect, as each of the plurality of yarn feed profiles is indexed over the course of the N repeats of the pattern repeat, each yarn feed controller uses each one of the N predetermined yarn feed profiles.

In another example, if the yarn feed profile is indexed to operatively control a different yarn feed controller after every pattern repeat, X=1, and if there are 5 predetermined yarn feed profiles so that N=5, after N·X=5 repeats (5 yarn feed profiles×1 index=5) of the pattern repeat, substantially the same feed length of yarn can be used from each of the plurality of yarns. In this example, each of the 5 predetermined yarn feed profiles can be indexed at the end of the pattern repeat to operatively control a yarn feed controller that has not previously been controlled by that particular yarn feed profile. Thus, after 5 repeats of the pattern repeat, each yarn feed controller can have been controlled by each one of the 5 predetermined yarn feed profiles, and substantially the same feed length of yarn can be used from each of the plurality of yarns.

In one aspect, the pattern repeat can be repeated N·X times for N predetermined yarn feed profiles. In another aspect, each yarn feed controller can be controlled by a different one of the N predetermined yarn feed profiles after every X pattern repeats of the pattern repeat. For example, if N=3 and X=4 (i.e., if there are 3 predetermined yarn feed profiles and the yarn feed profile is indexed after 4 pattern repeats), after every 4 pattern repeats, each yarn feed controller can be controlled by a different one of the 3 predetermined yarn feed profiles. Further, over the course of 12 pattern repeats, each yarn feed controller can use each one of the 3 predetermined yarn feed profiles.

In operation, according to one embodiment, a pattern tufted article can be formed by determining a plurality of predetermined yarn feed profiles for selected stitches of a programmed pattern to be tufted. In one aspect, in order to determine each yarn feed profile, a base yarn feed value can be determined for each stitch of the yarn for each pattern repeat of the programmed pattern. In another aspect, after determination of the base yarn feed value for each stitch, the base yarn feed value for at least one stitch of the yarn for each pattern repeat can be modified. In still another aspect, modification from the base yarn feed value for at least one stitch for each pattern repeat can continue until the feed length of yarn per pattern repeat is substantially the same for each of the plurality of predetermined yarn feed profiles. In one aspect, yarns from the plurality of yarns can be fed to the tufting machine at a predetermined yarn feed rates according to the respective yarn feed profile for each stitch of the pattern until the pattern is completed. Because the base yarn feed value can be modified for at least one stitch of the yarn for each pattern repeat until the feed length of yarn per pattern repeat is substantially the same for each plurality of predetermined yarn feed profiles, for each repeat of the programmed pattern, substantially the same feed length of yarn can be used for each of the plurality of yarns.

According to another embodiment, in operation, a patterned tufted article can be formed by determining a plurality of N predetermined yarn feed profiles for selected stitches of a programmed pattern to be tufted. In one aspect, after every X pattern repeats, each of the plurality of predetermined yarn feed profiles can be indexed to operatively control a different yarn feed controller 8. In another aspect, yarns can be fed from a plurality of yarn feed controllers at the selected respective predetermined yarn feed profiles for each stitch of the pattern until the pattern is completed. Because the yarn feed profiles index after every X pattern repeats, after N·X pattern repeats, substantially the same feed length of yarn can be used for each of the plurality of yarns.

In this embodiment, when X is equal to 1, each yarn feed controller 8 can be controlled by a different one of the N predetermined yarn feed profiles for each of the respective pattern repeats. As can be appreciated then, over the course of the N repeats of the pattern repeat, each yarn feed controller can use each one of the N predetermined yarn feed profiles. Similarly, when X is equal to 1, each yarn feed controller can be controlled by a different one of the N predetermined yarn feed profiles after every pattern repeat. As can be appreciated then, when X=1, over the course of the N repeats of the pattern repeat, each yarn feed controller can use each one of the N predetermined yarn feed profiles.

Figure 4A:
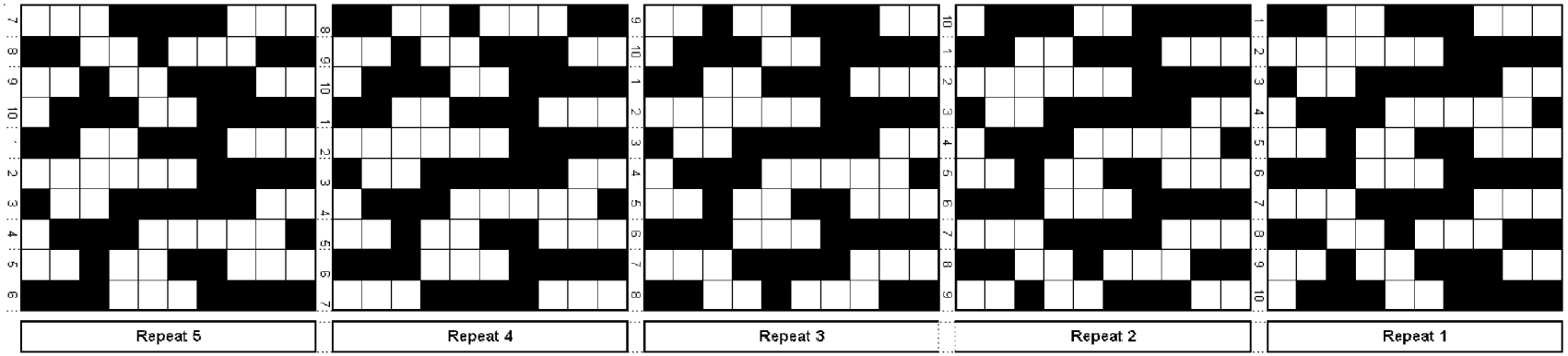
FIGS. 4A and 4B is an exemplary pattern for input into the control system of the tufting machine for the production of carpet having a varied pile height in which at least two predetermined yarn feed profiles of a plurality of predetermined yarn feed profiles are different. In this example, substantially the same feed length of yarn is used for each of the plurality of yarns after 10 repeats of the pattern repeat (N·X=10·1). The respective relative high/low feed profiles for each respective needle is shown for each pattern repeat (illustrating an exemplary one needle shift for each repeat).
Figure 4B:
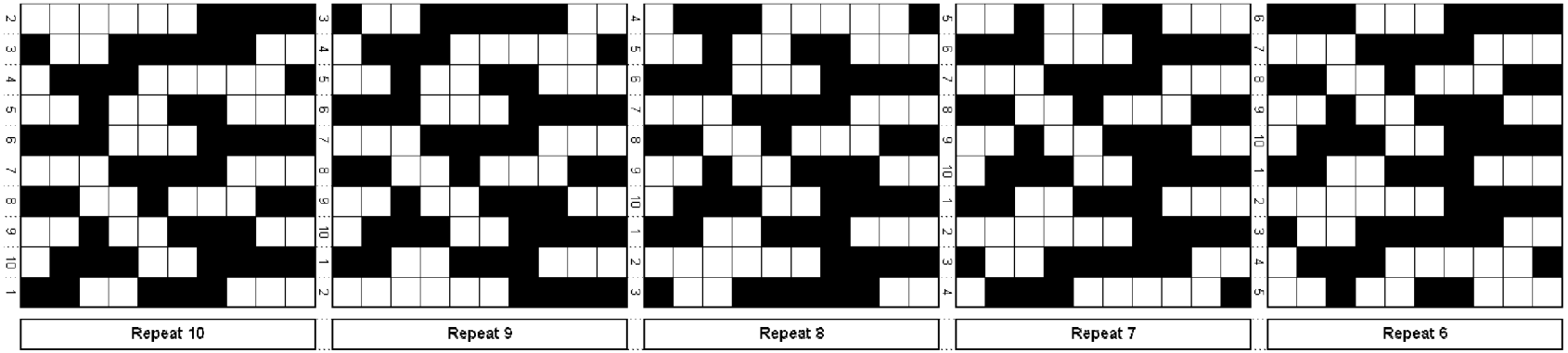

In one exemplary aspect and referring to FIGS. 4A and 4B, an exemplary pattern for input into the system controller 12 of the control system 10 of the tufting machine for the production of carpet having a varied pile height in which at least two predetermined yarn feed profiles of a plurality of predetermined yarn feed profiles are different. In this example, substantially the same feed length of yarn is used for each of the plurality of yarns after 10 repeats of the pattern repeat (N·X=10·1). As illustrated, each white square denotes a Low feed rate profile and each black square denotes a Hi feed rate profile for each of the needle/stitch combinations in the exemplary pattern that is repeated 10 times. In this particular example and as one skilled in the art will appreciate, the pattern is repeated 10 times but is shifted one needle upon each sequential repeat of the pattern. Thus, after the 10 repeats are accomplished, substantially the same feed length of yarn is used for each of the plurality of yarns will be used.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A method for forming patterned tufted articles, comprising:

determining a base yarn feed value for each stitch of each yarn of a plurality of yarns for each pattern repeat of a programmed tufted pattern;

calculating a feed length for each yarn of the plurality of yarns for each pattern repeat of the programmed tufted pattern using the base yarn feed value for each stitch of each yarn;

modifying the base yarn feed value of at least one stitch of at least one yarn of the plurality of yarns to a modified yarn feed value;

assigning a modified yarn feed profile to each yarn of the plurality of yarns based on the modified yarn feed value of at least one stitch of the at least one yarn of the plurality of yarns, wherein the modified yarn feed profile of each yarn comprises an optimized feed length, and wherein the optimized feed length of each yarn of the plurality of yarns is substantially the same for each pattern repeat;

controlling the operation of a plurality of yarn feed controllers of a tufting machine using the modified yarn feed profiles, wherein each of the plurality of yarn feed controllers are operably coupled to a respective yarn feed motor of a plurality of yarn feed motors, and wherein each yarn feed controller controls the amount of yarn being supplied by the respective yarn feed motor.

2. The method of claim 1, further comprising modifying the base yarn feed values of a plurality of stitches of at least one yarn of the plurality of yarns.

3. The method of claim 1, further comprising modifying the base yarn feed value of at least one stitch of at least two yarns of the plurality of yams.

4. The method of claim 1, wherein the variation from the base yarn feed value to the modified yarn feed value of any one of the at least one stitch is less than 0.3 inches.

5. The method of claim 1, wherein the variation from the base yarn feed value to the modified yarn feed value of any one of the at least one stitch is less than 0.2 inches.

6. The method of claim 1, wherein the variation from the base yarn feed value to the modified yarn feed value of any one of the at least one stitch is less than 0.1 inches.

7. The method of claim 1, wherein the variation from the base yarn feed value to the modified yarn feed value of any one of the at least one stitch is less than 0.05 inches.

8. The method of claim 1, wherein the at least one stitch further comprises a first stitch and a second stitch, wherein the variation from the base yarn feed value to the modified yarn feed value of the first stitch is either a positive or a negative variation, and wherein there is no variation from the base yarn feed value to the modified feed yarn value of a second one of the at least one stitch.

9. The method of claim 1, wherein each of the yarn feed controllers are operably coupled to a drive roll, and further comprising controlling the operation of the plurality of yarn feed controllers to draw the plurality of yarns from a yarn source at a substantially constant yarn feed rate.

10. The method of claim 9, wherein the plurality of modified yarn feed profiles have an average feed control rate, and further comprising selectively controlling the yarn feed rate to be less than, the average feed control rate of the plurality of modified yarn feed profiles.

11. The method of claim 9, wherein the plurality of modified yarn feed profiles have an average feed control rate, and further comprising selectively controlling the yarn feed rate to be equal to the average feed control rate of the plurality of modified yarn feed profiles.

12. The method of claim 1, wherein the plurality of modified yarn feed profiles have an average feed control rate, and further comprising selectively controlling the yarn feed rate to be greater than the average feed control rate of the plurality of modified yarn feed profiles.

13. A method for forming patterned tufted articles, comprising:

determining of N predetermined yarn feed profiles for selected stitches of a programmed tufted pattern, wherein the programmed tufted pattern comprises X pattern repeats;

controlling the operation of a plurality of yarn feed controllers of a tufting machine to feed a plurality of yarns to a corresponding one of a plurality of needles for tufting according to a selected one of the N predetermined yarn feed profiles; and indexing each of the N predetermined yarn feed profiles to operatively control a different yarn feed controller after every X pattern repeat;

wherein, after N·X repeats of the pattern repeat, each yarn of the plurality of yarns has a respective feed length of yarn that is used, and wherein the feed length of each yarn of the plurality of yarns is substantially equal to the feed length of every other yarn of the plurality of yarns.

14. The method of claim 13, wherein at least two predetermined yarn feed profiles of the N predetermined yarn feed profiles are different.

15. The method of claim 13, wherein X=1, and wherein the pattern repeat is repeated N times for N predetermined yarn feed profiles.

16. The method of claim 13, further comprising controlling each yarn feed controller by a different one of the N predetermined yarn feed profiles for each of the X pattern repeats.

17. The method of claim 16, wherein, over the course of the N-X repeats of the pattern repeat, each yarn feed controller uses each one of the N predetermined yarn feed profiles.

18. The method of claim 13, wherein each of the yarn feed controllers are operably coupled to a drive roll, and further comprising controlling the operation of each of of the plurality of yarn feed controllers to draw the plurality of yarns from a yarn source at a substantially constant yarn feed rate.

19. The method of claim 18, wherein the N predetermined yarn feed profiles have an average feed control rate, and further comprising selectively controlling the yarn feed rate to be less than, the average feed control rate of the N predetermined yarn feed profiles.

20. The method of claim 18, wherein the N predetermined yarn feed profiles have an average feed control rate, and further comprising selectively controlling the yarn feed rate to be equal to the average feed control rate of the N predetermined yarn feed profiles.

21. The method of claim 13, wherein the N predetermined yarn feed profiles have an average feed control rate, and further comprising selectively controlling the yarn feed rate to be equal to the average feed control rate of the N predetermined yarn feed profiles.

22. The method of claim 13, further comprising, for each of the N predetermined yarn feed profiles:

determining a base yarn feed value for each stitch of each yarn of the plurality of yarns for each of the X pattern repeats of the programmed tufted pattern;

calculating a feed length for each yarn of the plurality of yarns for each X pattern repeat of the programmed tufted pattern using the barn yarn feed value for each stitch of each yarn;

modifying the base yarn feed value of at least one stitch of at least one yarn of the plurality of yarns to a modified yarn feed value; and assigning a modified yarn feed profile to each yarn of the plurality of yarns based on the modified yarn feed value of at least one stitch of the at least one yarn of the plurality of yarns, wherein the modified yarn feed profile of each yarn comprises an optimized feed length, and wherein the optimized feed length of each yarn of the plurality of yarns is substantially the same for each pattern repeat.

* * * * *